United States Patent [19]

Threatt

[11] Patent Number: 4,964,394

[45] Date of Patent: Oct. 23, 1990

[54] WATER HEATER WITH HEAT TRAP IN DIP TUBE

[75] Inventor: Gary S. Threatt, Kershaw, S.C.

[73] Assignee: A.O. Smith Corporation, Milwaukee, Wis.

[21] Appl. No.: 348,975

[22] Filed: May 9, 1989

[51] Int. Cl.[5] ..... F24H 1/00

[52] U.S. Cl. ..... 126/361; 126/362; 126/350; 137/433; 236/93 R

[58] Field of Search ..... 126/361, 362, 350; 137/496, 433, 590, 592; 236/102, 93 R

[56] References Cited

U.S. PATENT DOCUMENTS

| | | | |
|---|---|---|---|
| 1,844,613 | 2/1932 | Thompson | 137/496 |
| 1,863,273 | 6/1932 | Hofferbert | 126/362 X |
| 1,897,492 | 2/1933 | Ledoux | 137/433 |
| 2,105,893 | 1/1938 | Salmonsen | 126/362 |
| 2,223,509 | 12/1940 | Brauer | 137/433 X |
| 2,764,427 | 9/1956 | Andrus . | |
| 2,971,532 | 2/1961 | McLaren et al. | 126/362 X |
| 3,144,904 | 8/1964 | Kahn et al. | 165/132 X |
| 3,190,284 | 6/1965 | Koepf . | |
| 3,285,241 | 11/1966 | Bordeaux | 126/362 |
| 3,319,980 | 5/1967 | Demetriff et al. | 126/362 X |
| 3,726,475 | 4/1973 | Eising . | |
| 3,776,456 | 12/1973 | Eising . | |
| 3,864,234 | 2/1975 | Wasson . | |
| 4,286,573 | 9/1981 | Nickel . | |

*Primary Examiner*—Larry Jones

*Attorney, Agent, or Firm*—Andrus, Sceales, Starke & Sawall

[57] ABSTRACT

A hot water heater (12) has a modified dip tube (70) with a heat trap (80, 78, 82, 74) therein. The cold water inlet pipe (90) is threaded directly into a spud (26) on the tank without an extra fitting (32) otherwise required for a heat trap, the heat trap function being performed in the dip tube (70) and eliminating the cost of a separate external heat trap fitting otherwise required for such function. The travel stroke of the heat trap sealing ball (80) is located entirely within the storage tank (14) to reduce noise caused by movement of the ball (80).

12 Claims, 3 Drawing Sheets

WATER HEATER WITH HEAT TRAP IN DIP TUBE

BACKGROUND AND SUMMARY

The invention relates to water heaters, and more particularly to heat traps therefore.

Heat traps for water heaters are known in the art, for example as shown in Nickel U.S. Pat. No. 4,286,573. The heat trap prevents heat loss to the external piping system. At the cold water inlet, the heat trap is provided by a fitting having a ball and a valve seat. The fitting is threadingly connected at one end to an external spud attached to the water heater, and is threadingly connected at the other end to the external cold water inlet pipe.

The present invention provides a cost reduction, and eliminates the extra fitting otherwise required for a heat trap. The present invention provides a heat trap in the dip tube extending downwardly internally in the water heater. Dip tubes are known in the art, for example as shown in U.S. Pat. Nos. 2,764,427, 3,726,475, 3,776,456 and 3,864,234. The dip tube introduces cold water into the water heater at a location spaced below the top of the storage tank.

The present invention modifies the dip tube and provides simple structure for performing the heat trap function within the dip tube, and eliminates the cost of a separate external heat trap fitting otherwise required for such function.

The invention also reduces noise caused by movement of a sealing member performing the heat trap function, by locating the travel stroke of the sealing member entirely within the storage tank.

BRIEF DESCRIPTION OF THE DRAWINGS

Prior Art

Present Invention

Figure 8:
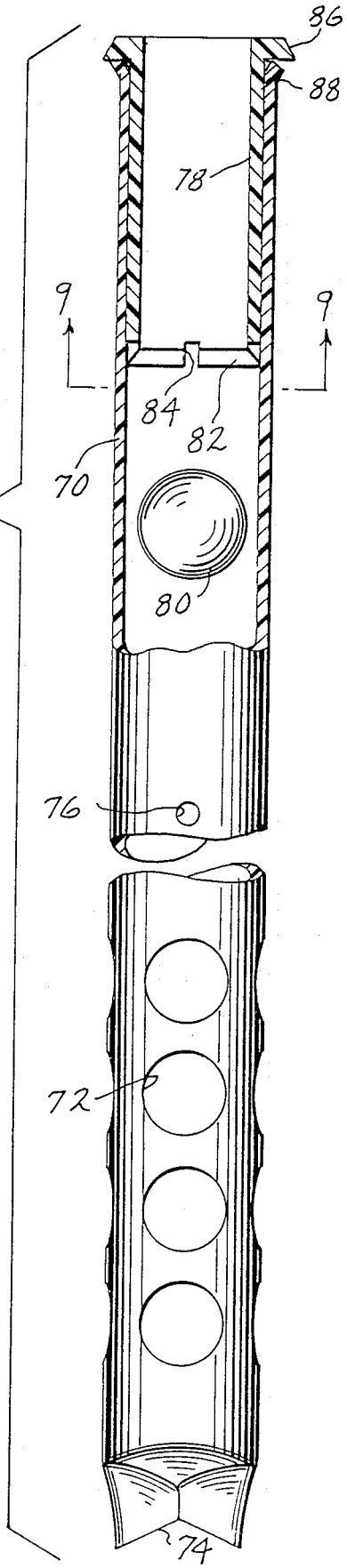

FIG. 8 is a partial sectional view of a dip tube modified in accordance with the invention and including a heat trap therein.

Figure 9:
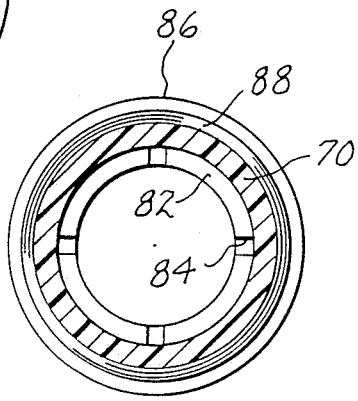

FIG. 9 is a sectional view taken along line 9—9 of FIG. 8.

Figure 10:
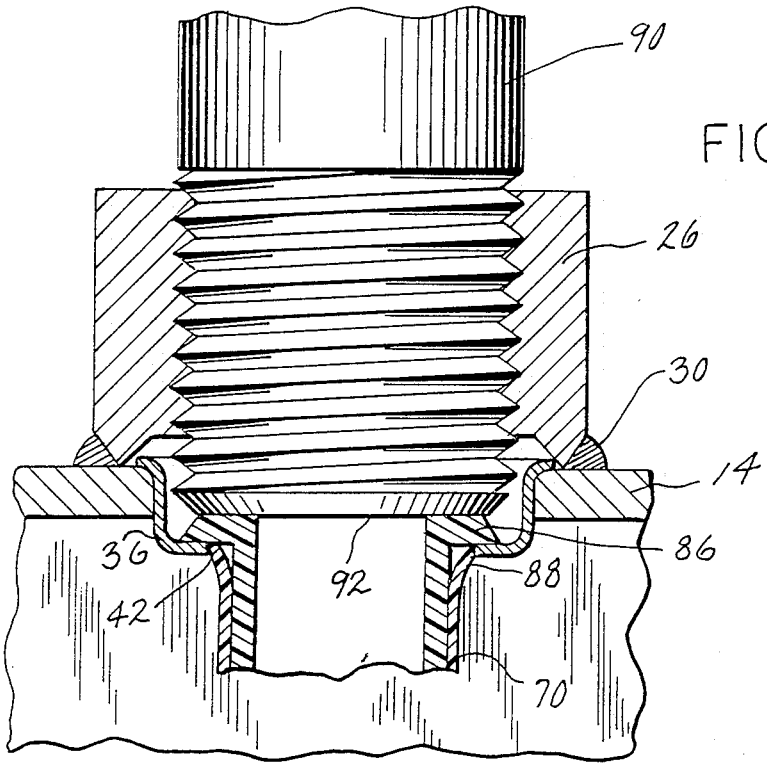

FIG. 10 is a sectional view showing mounting of the dip tube of FIG. 8.

Figure 11:
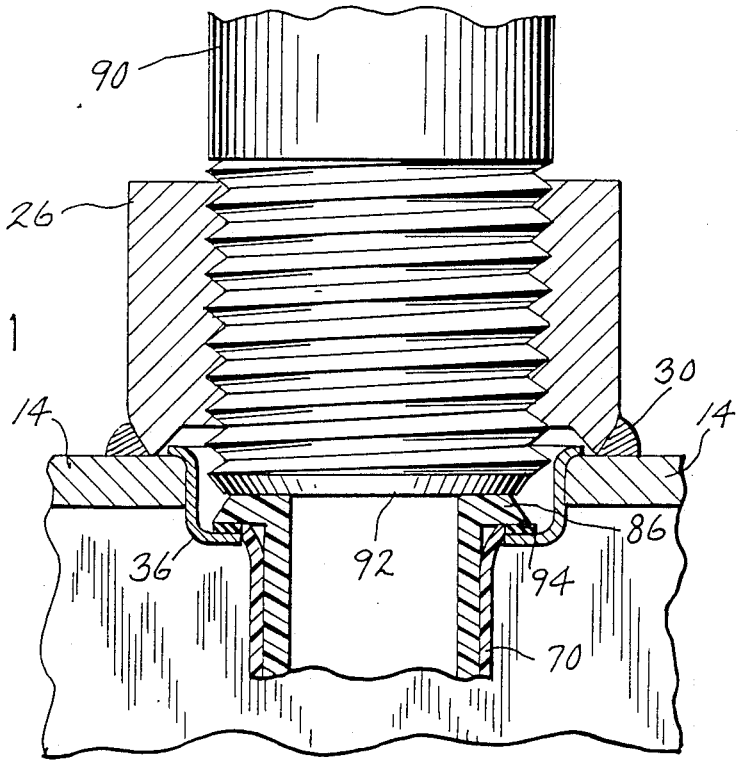

FIG. 11 is a view like FIG. 10 and shows a further embodiment.

DETAILED DESCRIPTION

Figure 1:
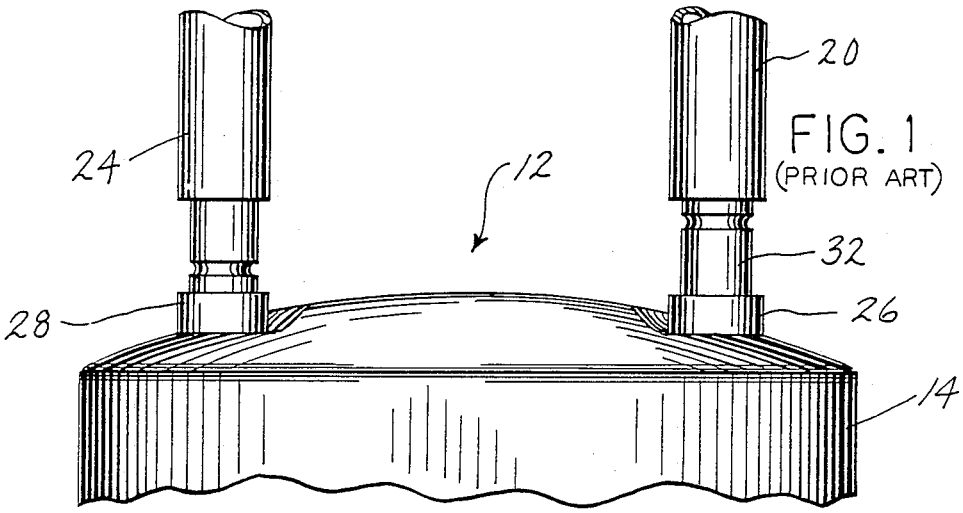
FIG. 1 (PRIOR ART)
FIG. 1 is a side elevation view of the top portion of the inner storage tank of a hot water heater known in the prior art.
Figure 6:
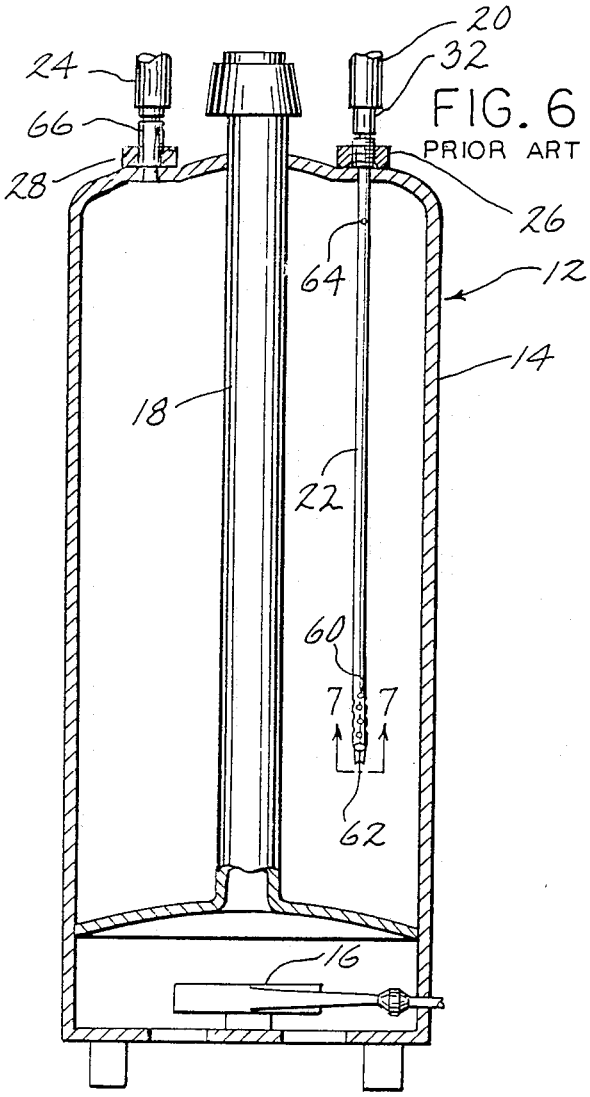
FIG. 6 PRIOR ART
FIG. 6 is a side sectional view of the inner storage tank of a hot water heater, and shows a dip tube extending downwardly therein.

Prior Art FIGS. 1 and 6 show a hot water heater 12 having an inner storage tank 14 for holding water to be heated by a lower burner assembly 16 or electric heating element or the like. Tank 14 is enclosed by an insulating jacket and an outer shell (not shown). Waste products of combustion are exhausted upwardly through flue 18. Cold water is introduced through cold water inlet pipe 20 and dip tube 22 into tank 14, and heated water exits through hot water outlet pipe 24.

Figure 2:
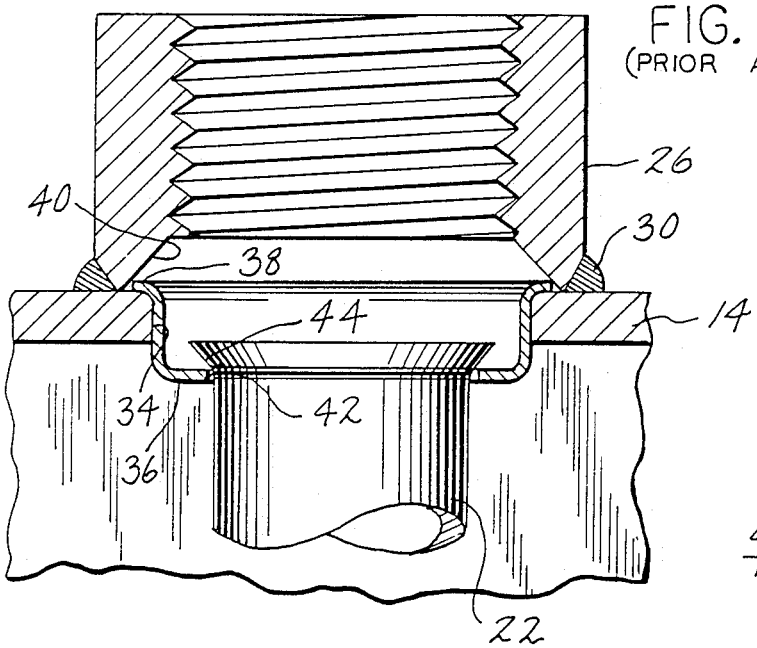
FIG. 2 (PRIOR ART)
FIG. 2 is a partial sectional view of a portion of FIG. 1.

Tank 14 has a pair of spuds 26 and 28 welded to the top external surface thereof, for example as shown at weldment 30 for spud 26, FIG. 2. The cold water inlet includes an external heat trap fitting 32 which is threadingly connected at its lower end to spud 26, and threadingly connected at its upper end to cold water inlet pipe 20. Storage tank 14 has an opening 34, FIG. 2, receiving an annular dip tube retainer 36 having an upper flange 38 trapped between the top of tank 14 and the lower inner beveled surface 40 of spud 26. Retainer 36 has an aperture 42 through which dip tube 22 is extended downwardly during installation until stopped by engagement of upper flared flange 44 against the edge of opening 42 of retainer 36. Heat trap fitting 32 is threaded downwardly into spud 26 until the lower end of fitting 32 engages the top of dip tube 22 at flared flange 44.

Figure 3:
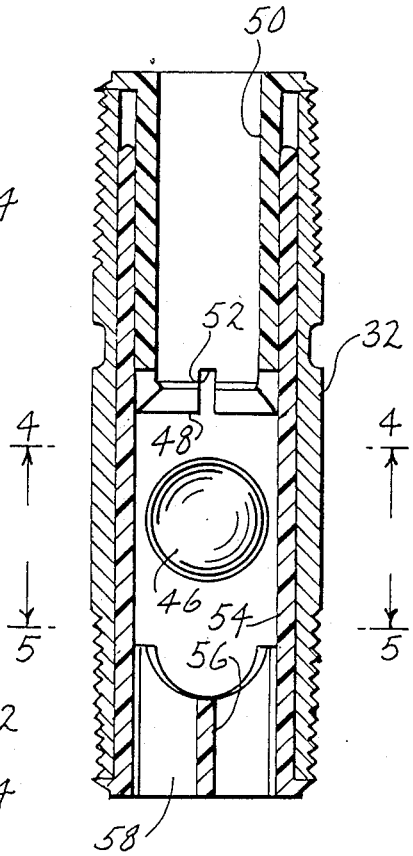
FIG. 3 (PRIOR ART)
FIG. 3 is a sectional view of the cold water inlet heat trap fitting of FIG. 1.
Figure 4:
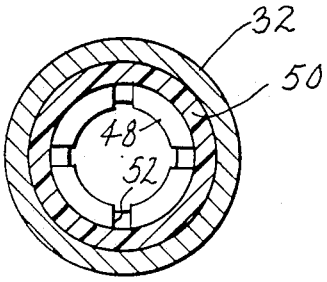
FIG. 4 (PRIOR ART)
FIG. 4 is a sectional view taken along line 4—4 of FIG. 3.
Figure 5:
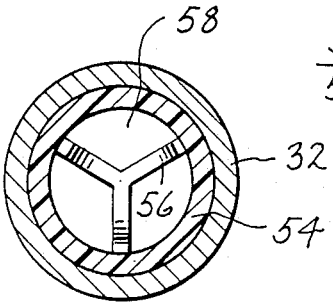
FIG. 5 (PRIOR ART)
FIG. 5 is a sectional view taken along line 5—5 of FIG. 3.
Figure 7:
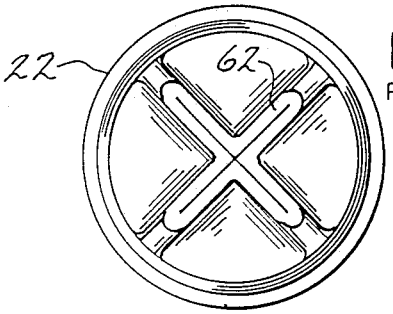
FIG. 7 PRIOR ART
FIG. 7 is a view taken along line 7—7 of FIG. 6.

Heat trap fitting 32 includes a movable sealing member provided by a ball 46, FIG. 3, having a density less than 1.0 such that it floats in water. When tank 14 is full, ball 46 floats upwardly into engagement with beveled valve seat 48 at the lower end of inner sleeve 50. This prevents heat loss upwardly through pipe 20. Slots 52 extending radially through the cylindrical sidewall of sleeve 50 at valve seat 48 and provide pressure relief. Another sleeve 54 has a plurality of lower radial spokes 56, FIGS. 3 and 5, stopping and holding ball 46 during incoming water flow. The water flows around ball 46 and through lower passages 58 between spokes 56. The incoming water flows downwardly through dip tube 22 and is discharged at lower holes 60, FIG. 6, in the dip tube. The bottom of the dip tube is crimped at 62 in a cross-shaped pattern, FIG. 7, to close the lower end thereof. Upper hole 64 in the dip tube is an anti-siphon hole.

The hot water outlet of the tank includes a heat trap fitting 66 with a ball having a density greater than 1.0, such that the ball sinks in water and closes a lower valve seat, to prevent heat loss, for example as shown in above noted Nickel U.S. Pat. No. 4,286,573. Heat trap fitting 66 is similar to heat trap fitting 32, but inverted.

Present Invention

FIG. 8 shows a dip tube 70 modified in accordance with the present invention. Dip tube 70 is a cylindrical tube of given diameter extending downwardly into tank 14 and has a plurality of lower holes 72 for discharging water into the tank, a lower closed crimped end 74, and an upper anti-siphon hole 76, all as comparable to dip tube 22. An inner cylindrical tubular insert 78 extends downwardly a given distance into dip tube 70. A sealing member is provided by ball 80 having a density less than 1.0 such that it floats in water. Ball 80 has a diameter less than the inner diameter of dip tube 70 and greater than the inner diameter of tubular insert 78. Lower crimped end 74 of dip tube 70 provides a lower stop in the dip tube spaced below the bottom end 82 of insert 78. Ball 80 is movable longitudinally upwardly and downwardly in dip tube 70 between the bottom end 82 of insert 78 and lower stop 74. Ball 80 floats in water upwardly into engagement with bottom end 82 of insert 78 to close same and prevent heat loss upwardly through and out of dip tube 70 and to prevent convection water currents upwardly through and out of dip tube 70. Ball 80 moves downwardly out of engagement with bottom end 82 of insert 78 in response to incoming water flowing through insert 78 and downwardly in dip tube 70.

Bottom end 82 of insert 78 is beveled comparably to beveled valve seat 48 in FIG. 3, and also includes slots 84 extending radially through the cylindrical sidewall of insert 78 to relieve pressure therethrough from the storage tank and the dip tube when the valve seat at bottom end 82 is closed. When ball 80 is seated against bottom end 82 of insert 78, there is still limited communication between the interior of dip tube 70 below ball 80 and the interior of tubular insert 78 above ball 80. In an alternative embodiment, pressure relief is provided by a porous ball 80.

Tubular insert 78 has an upper portion 86 extending above the upper end 88 of dip tube 70 and flared radially outwardly to form a flange extending radially beyond dip tube 70. During installation, dip tube 70 is inserted downwardly through opening 42, FIG. 10, in dip tube retainer 36 until stopped by engagement of flange 86 against retainer 36. Cold water inlet pipe 90 is threaded downwardly into spud 26 until the bottom end 92 of the pipe engages flange 86 in tight sealing relation. Dip tube 70 and tubular insert 78 are preferably polypropolyene. In an alternative embodiment, FIG. 11, an annular sealing gasket 94 may be provided between flange 86 and retainer 36. Insert 78 is pressed into dip tube 70 with a tight interference fit to retain dip tube 70 on insert 78 and to prevent water from creeping back up along the interface therebetween.

The modified dip tube in accordance with the present invention enables a cold water inlet pipe to be threaded directly into spud 26 without an extra fitting for a heat trap as at 32. The heat trap function is instead performed in the dip tube. This eliminates the cost of a separate external heat trap fitting otherwise required for such function. This cost reduction is significant in high sales volume water heaters.

The invention also locates the travel stroke of ball 80 entirely within storage tank 14 to reduce noise caused by movement of ball 80. In the prior art, movement of ball 46 in the external piping is audible as a faint tapping sound, which may be objectionable in various applications. The present invention solves this problem.

It is recognized that various equivalents, alternatives and modifications are possible within the scope of the appended claims.

I claim:

1. A water heater comprising a storage tank holding water to be heated, an opening in said tank, a dip tube extending downwardly into said tank from said opening for introducing water into said tank, an upper valve seat in said dip tube, a lower stop in said dip tube, a sealing member in said dip tube and movable longitudinally upwardly and downwardly therein between said upper valve seat and said lower stop, said sealing member having a density less than water such that said sealing member floats in water upwardly into engagement with said valve seat to close same and prevent heat lose upwardly through and out of said dip tube and to prevent convection water currents upwardly through and out of said dip tube, said sealing member moving downwardly out of engagement with said valve seat in response to incoming water flowing through said valve seat and downwardly in said dip tube, an external spud attached to said tank at said opening, and an inlet water pipe threaded directly into said spud without an extra fitting for a heat trap, the heat trap function being performed in said dip tube and eliminating the cost of a separate external heat trap fitting otherwise required for such function.

2. The invention according to claim 1 wherein said dip tube has one or more outlet openings discharging water into said tank, and said valve seat is above said outlet openings.

3. The invention according to claim 2 wherein said lower stop is below said outlet openings, such that said sealing member is movable along a travel stroke extending above and below said outlet openings.

4. The invention according to claim 3 wherein said lower stop is at the bottom of said dip tube.

5. The invention according to claim 4 wherein said lower stop comprises a crimped portion of said dip tube at the bottom end thereof.

6. A water heater comprising a storage tank holding water to be heated, a dip tube comprising a cylindrical tube of given diameter extending downwardly into said tank for introducing water into said tank, an inner cylindrical tubular insert extending downwardly a given distance into said dip tube, a lower stop in said dip tube spaced below the bottom end of said tubular insert, a sealing member in said dip tube having a given diameter less than the inner diameter of said dip tube and greater than the inner diameter of said tubular insert, said sealing member being movable longitudinally upwardly and downwardly in said dip tube between said bottom end of said tubular insert and said lower stop, said sealing member having a density less than water such that said sealing member floats in water upwardly into engagement with said bottom end of said tubular insert to close same and prevent heat loss upwardly through and out of said dip tube and to prevent convection water currents upwardly through and out of said dip tube, said sealing member moving downwardly out of engagement with said bottom end of said tubular insert in response to incoming water flowing through said tubular insert and downwardly in said dip tube.

7. The invention according to claim 6 comprising pressure relief means in said dip tube relieving pressure therethrough from said tank and said dip tube upwardly through said tubular insert when said sealing member is seated against said bottom end of said tubular insert.

8. The invention according to claim 7 wherein said tubular insert comprises a cylindrical sidewall, and wherein said pressure relief means comprises one or more slots extending radially through said cylindrical sidewall of said tubular insert, such that when said sealing member is seated against said bottom end of said tubular insert, there is still limited communication through said radial slots between the interior of said dip tube below said sealing member and the interior of said tubular insert above said sealing member.

9. The invention according to claim 7 wherein said sealing member is porous and provides pressure relief.

10. The invention according to claim 6 wherein said tubular insert has an upper portion extending above the upper end of said dip tube and flared radially outwardly to form a flange extending radially outwardly beyond said dip tube.

11. The invention according to claim 10 wherein said tank has an opening therein, and comprising a dip tube retainer mounted in said opening and having an aperture through which said dip tube extends, said aperture having a diameter greater than the outer diameter of said dip tube and less than the outer diameter of said flange of said tubular insert, and comprising an external spud mounted to said tank at said opening, and a cold water inlet pipe threaded into said spud and having a lower end engaging the top of said flange of said tubular insert in sealing relation.

12. The invention according to claim 11 comprising an annular sealing gasket between said flange of said tubular insert and said dip tube retainer.

* * * * *